US006044516A

United States Patent [19]

Lev

[11] Patent Number: 6,044,516

[45] Date of Patent: Apr. 4, 2000

[54] PLASTERING TROWEL

[75] Inventor: Avraham Lev, 18 Sanhedrin Street, Rosh Ha'ayin, Israel

[73] Assignees: Avraham Lev; Amit Geller, both of Rosh Haayin, Israel

[21] Appl. No.: 08/936,683

[22] Filed: Sep. 24, 1997

[51] Int. Cl.[7] ..... B05C 17/10

[52] U.S. Cl. ..... 15/235.4; 425/458

[58] Field of Search ..... 15/235.3, 235.4, 15/235.5, 235.6, 235.7, 235.8; 425/458; 404/97

[56] References Cited

U.S. PATENT DOCUMENTS 3,341,878 9/1967 Hubbard .
4,253,214 3/1981 Bushee ..... 15/235.4
5,193,244 3/1993 Meyers ..... 15/235.4

*Primary Examiner*—Terrence R. Till
*Assistant Examiner*—Jennifer C. McNeil
*Attorney, Agent, or Firm*—Mark M. Friedman

[57] ABSTRACT

A plastering trowel for spreading plaster on a wall has a substantially rectangular sheet of material and a handle attached to the rear surface. The sheet is made from flexible material and has a curvature such that the front spreading surface is concave along its length. When the plastering trowel is positioned with the front spreading surface adjacent to the wall and the handle is manually urged towards the wall, the sheet flexes such that the front spreading surface becomes approximately planar. Preferably, the long edges of the sheet are rounded away from the front spreading surface. The sheet also preferably has rounded corners and slightly curved short edges.

11 Claims, 6 Drawing Sheets

PLASTERING TROWEL

FIELD AND BACKGROUND OF THE INVENTION

The present invention relates to tools used in building and decorating and, in particular, it concerns a plastering trowel with a concavely curved flexible spreading surface.

It is known to use a trowel to apply and spread plaster on walls. The commonly used trowel design, illustrated as trowel 10 in FIG. 1, employs a planar, rectangular, metal blade 12 rigidly connected at one or two points to a raised handle 14.

Plastering generally requires considerable skill and expertise. The plaster must be evenly spread to conceal imperfections in the underlying wall 16 and to avoid forming undulating waves. Each stroke of trowel 10 used to spread the plaster tends to leave ridges 18 where material was pushed out from the sides of the trowel, and also leaves behind residual material and dirt originating from the wall surface and from the plaster. Additionally, it the trowel is not held exactly parallel to, and at the correct inclination to, the surface, the sharp corners and edges of the trowel form additional lines or scrapes, reducing the quality of the finished surface.

There is therefore a need for a plastering trowel which facilitates easy spreading of plaster without forming ridges, lines or scrapes, which will help to remove residual material and dirt, and which will render unnecessary the additional labor of rubbing down the wall before application of a second layer.

SUMMARY OF THE INVENTION

The present invention is a plastering trowel with a concavely curved flexible spreading surface.

According to the teachings of the present invention there is provided, a trowel for spreading material on a wall, the trowel comprising: (a) a substantially rectangular sheet of material having a front spreading surface and a rear surface, the front spreading surface having a longer dimension termed "length" and a shorter dimension termed "width"; and (b) a handle attached to the rear surface, wherein the sheet has a curvature such that the front spreading surface is concave along the length, the material being flexible such that, when the trowel is positioned with the front spreading surface adjacent to the wall and the handle is manually urged towards the wall, the sheet flexes such that the front spreading surface becomes approximately planar.

According to a further feature of the present invention, the sheet has two, parallel long edges separated by the width, the long edges being rounded away from the front spreading surface.

According to a further feature of the present invention, the sheet has four corners, each of the corners being rounded with a minimum radius of curvature of about 1 cm.

According to a further feature of the present invention, the sheet has two short edges separated by the length, the short edges being curved with a minimum radius of curvature of about 10 cm.

According to a further feature of the present invention, the sheet has at least one unobstructed aperture of diameter no greater than about ½ cm to facilitate equalization of pressure between adjacent to the front spreading surface and adjacent to the rear surface.

According to a further feature of the present invention, the sheet is made from a polymer material.

According to a further feature of the present invention, the handle is formed with a substantially planar face adjacent to the rear surface and extending along a major part of the length of the sheet such that the face spreads applied pressure along the length when the sheet is in the approximately planar flexed state.

According to a further feature of the present invention, the weight of the handle is at least about twice the weight of the sheet.

According to a further feature of the present invention, the weight of the handle alone is between about 150 and about 200 grams, and preferably between about 160 and about 180 grams.

BRIEF DESCRIPTION OF THE DRAWINGS

The invention is herein described, by way of example only, with reference to the accompanying drawings, wherein:

FIG. 7B is a side view of the handle of FIG. 7A; and

DESCRIPTION OF THE PREFERRED EMBODIMENTS

The present invention is a plastering trowel with a concavely curved flexible spreading surface.

The principles and operation of plastering trowels according to the present invention may be better understood with reference to the drawings and the accompanying description.

Figure 1:
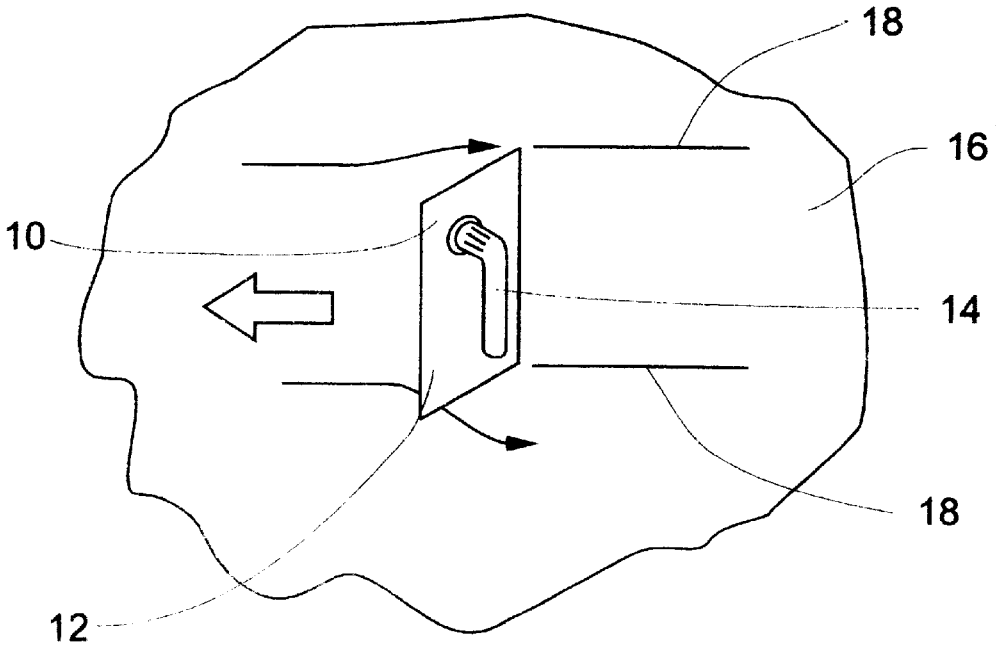
Fig. 1(PRIOR ART)
FIG. 1 is a schematic perspective view of a conventional plastering trowel being employed to spread plaster on a wall.
Figure 2:
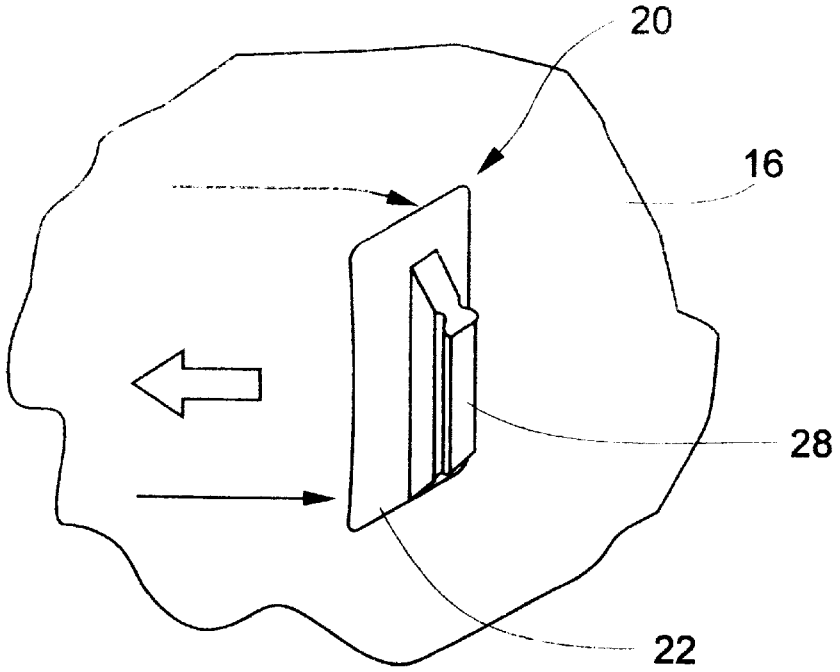
FIG. 2 is a schematic perspective view of a plastering trowel constructed and operative according to the teachings of the present invention being employed to spread plaster with its spreading surface inclined to a wall.
Figure 3B:
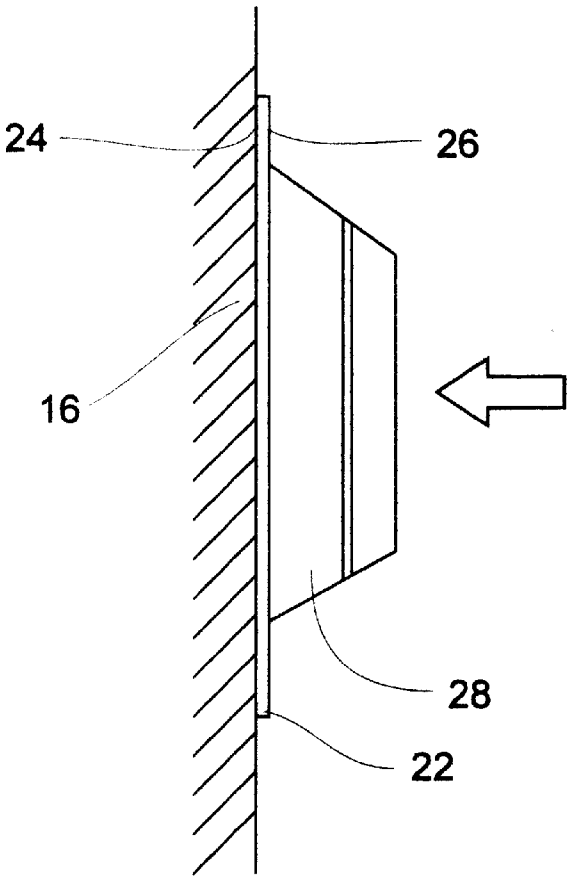
FIG. 3B is a view similar to FIG. 3A showing the flexing of the spreading surface when manual pressure is applied towards the wall.
Figure 3A:
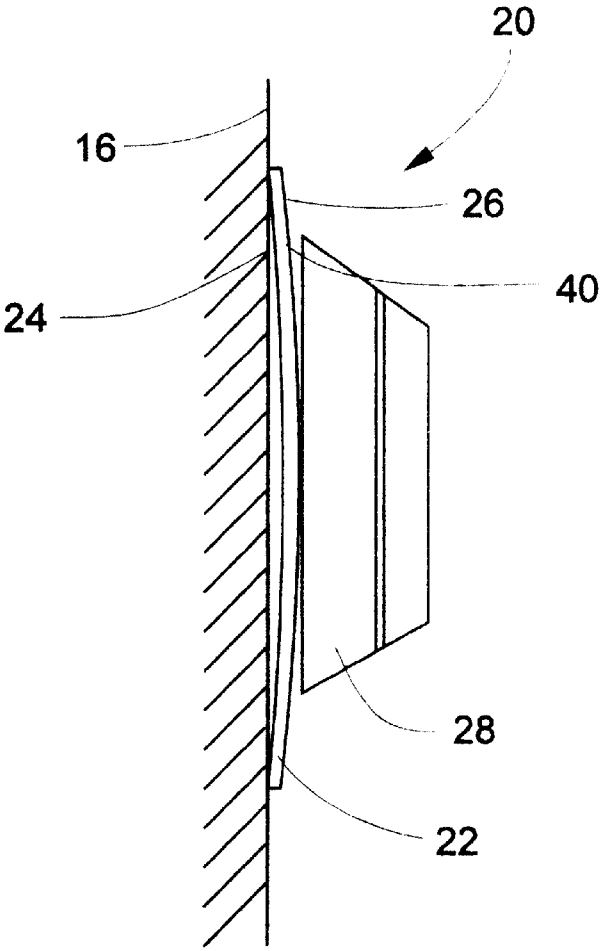
FIG. 3A is a side view of the plastering trowel of FIG. 2 being held adjacent and parallel to a wall.
Figure 4:
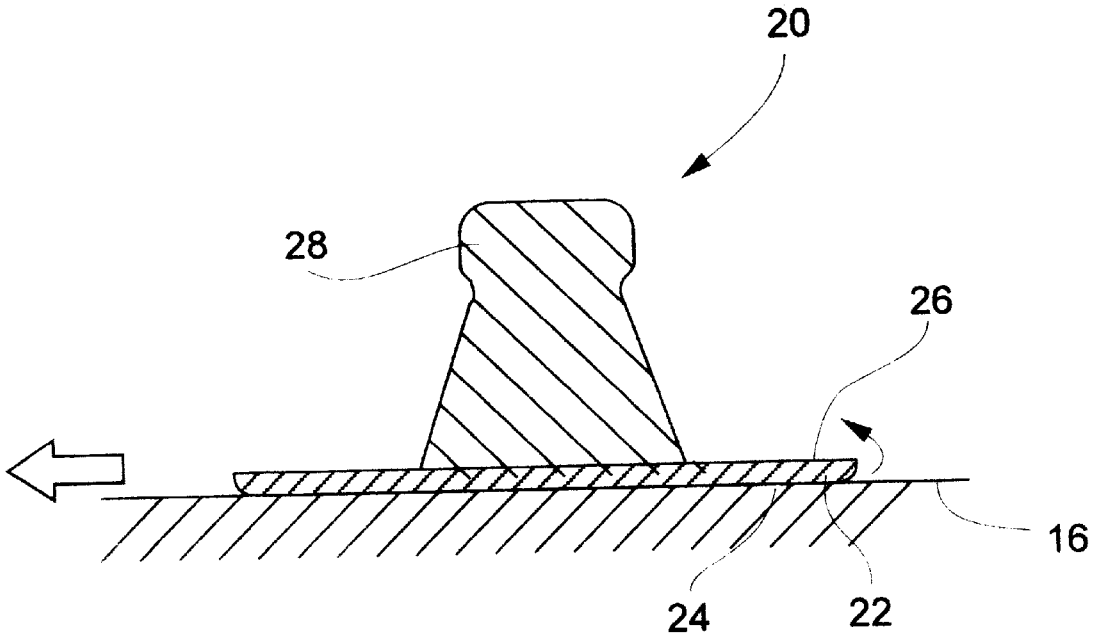
FIG. 4 is a schematic cross-sectional view of the plastering trowel of FIG. 2 being used to spread plaster with its spreading surface lying flat against a wall.

Referring now to the drawings, FIGS. 2–4 show a plastering trowel, generally designated 20, constructed and operative according to the teachings of the present invention, for spreading plaster on wall 16. Generally speaking, plastering trowel 20 is formed from a substantially rectangular sheet of material 22 having a front spreading surface 24 and a rear surface 26. A handle 28 is attached to rear surface 26. Sheet 22 has a curvature such that front spreading surface 24 is concave along its length (FIG. 3A).

Sheet 22 is designed to be flexible such that, when plastering trowel 20 is positioned with front spreading surface 24 adjacent to wall 16 and handle 28 is manually urged towards the wall, sheet 22 flexes such that the front spreading surface becomes approximately planar (FIG. 3B).

It should be noted that the aforementioned curvature and flexibility of sheet 22 provides unique functionality of plastering trowel 20. In a first mode of use shown in FIG. 2, with spreading surface 24 held at an inclination to the wall the curvature of sheet 22 helps to eliminate ridges formed by plaster displaced from the ends of the trowel. Without in any way limiting the scope of the invention, it is believed that this advantage results from angling of the end parts of spreading surface 24 towards the intermediate portion of the surface. This angling gives a funnel-like effect in which plaster within the sweep area of the trowel stroke is kept within that area. The rounding of the corners and ends of sheet 22, to be described below, also helps prevent formation of lines.

In a second mode of use shown in FIGS. 3B and 4, the flexibility of sheet 22 allows spreading surface 24 to be pressed flat against wall 16. This mode facilitates flattening of the surface by filling the small depressions usually present in an unfinished wall, as well as smooth finishing of the wall surface.

It will be clear that trowel 20 may be used to replace a conventional trowel in any application for applying, distributing or smoothing spreadable material on a surface. The material spread is typically of a type which adds non-trivially to the thickness of the wall, as distinct from paint and other surface coloring or treating compositions. Examples include, but are not limited to, plaster, plaster-containing and plaster-substitute compositions, and mortar. By way of a typical non-limiting example trowel 20 will be described in the context of spreading plaster on a wall.

Figure 5A:
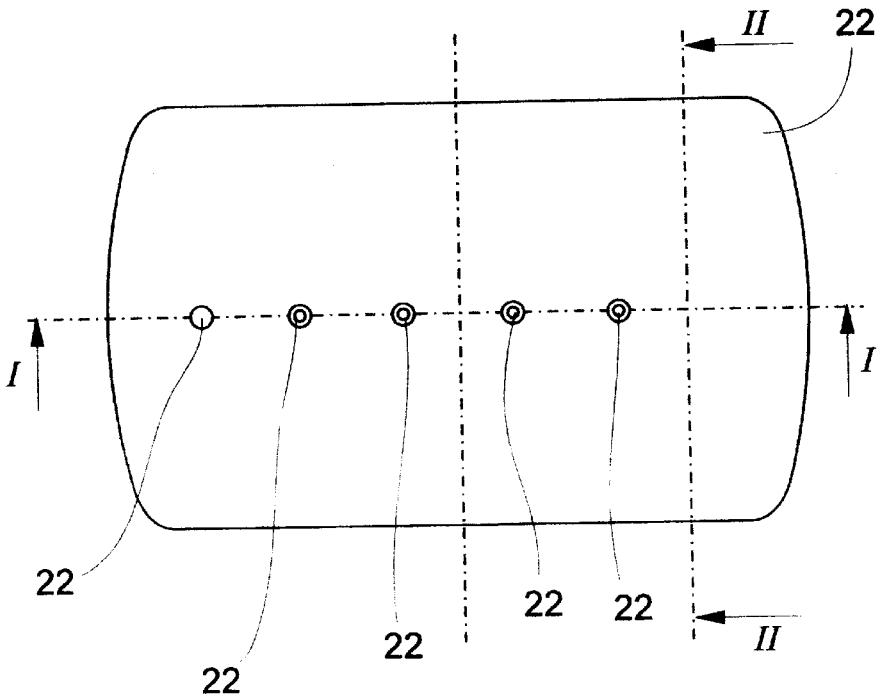
FIG. 5A is a plan view of the spreading surface of the plastering trowel of FIG. 2.
Figure 5C:
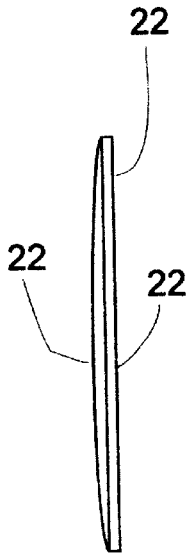
FIG. 5C is a transverse cross-sectional view taken along the line II—II of FIG. 5A.
Figure 5B:
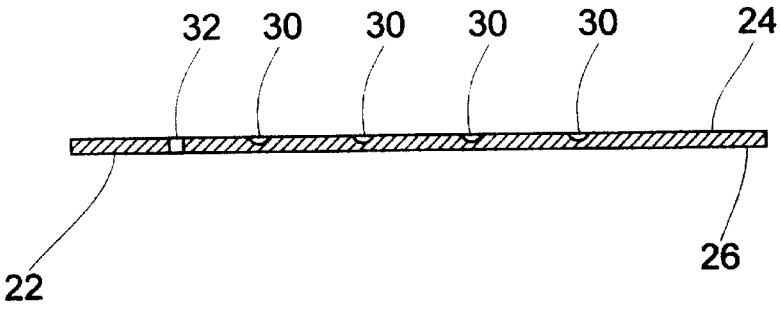
FIG. 5B is a longitudinal cross-sectional view taken along the line I—I of FIG. 5A.

Turning now to the features of trowel 20 in more detail, sheet 22 is shown separately in FIGS. 5A–5C. Sheet 22 is substantially rectangular with a longer dimension termed its "length" of between about 20 and about 30 cm and a shorter dimension termed its "width" of between about 10 and about 20 cm. Preferably, the length is between about 25 and about 28 cm and the width is between about 14 and about 17 cm. The thickness of sheet 22 depends on the strength and flexibility of the material from which it is made. Typically, in the case of polypropylene, a thickness of between about 2 and about 4 mm is preferred.

Parenthetically, it should be noted that the aforementioned dimensions are considered to be those most appropriate for a trowel to be used manually. However, in an alternative implementation, a trowel according to the teachings of the present invention could be used in a mechanized or robotic system. In this case, a length of about ½ m is typically used, the other dimensions being scaled in proportion.

As mentioned earlier, the curvature of sheet 22 is along its length. In other words, a longitudinal cross-section (FIG. 5B) is curved while a transverse cross-section (FIG. 5C) is substantially straight. The curvature along the length typically corresponds to a radius of curvature of between about ½ m to about 1 m, giving an arched height of between about ½ cm and about 2 cm. The direction of curvature is such that spreading surface 24 is concave.

The long edges running parallel to the length of sheet 22 and separated by its width are preferably rounded away from front spreading surface 24 (see FIGS. 4 and 5B). The exact curvature is not critical, but typically has a radius of curvature of not less than a few mm. This rounding of the edges allows efficient finishing with spreading surface 24 pressed flat against wall as illustrated in FIG. 4. On the leading edge, the curvature enables the trowel to ride over any slightly raised material in front of the trowel. On the trailing edge, the curvature has been found to provide a cleaning effect in which dirt tends to be lifted away from the wall surface and collects on the periphery of rear surface 26 of sheet 22.

The aforementioned rounding of the edges need not extend to the shorter edges of sheet 22. However, it is important that any transitions between different edge profiles is achieved smoothly without any discontinuities which could cause marking.

It is a particular feature of some preferred implementations of the present invention that sheet 22 has rounded corners. This helps to prevent scratching or marking of the plaster by accidental contact with the corners. Typically, each corner is rounded with a minimum radius of curvature of about 1 cm.

Optionally, the shorter edges of sheet 22, i.e., those running across the width of the sheet and separated by its length, may additionally, or alternatively, be curved. The radius of curvature of the shorter edges is typically at least about 10 cm. This also helps to prevent formation of lines on the wall during spreading.

It should be noted in this context that sheet 22 is described as "substantially rectangular" in the sense that it has four identifiable edges which run roughly parallel or perpendicular to each other, giving the visual impression of a rectangular shape. However, as will be clear from the described curvature of the corners and shorter sides, the shape of sheet 22 typically varies considerably from a true rectangle.

Sheet 22 typically features a number of countersunk holes 30 for receiving screws to attach sheet to handle 28. Between two and four holes 30 are usually employed. Optionally, holes 30 may be configured to receive small plastic covers for the screw heads.

Besides for any screw holes provided, sheet 22 preferably features at least one unobstructed aperture 32 of diameter no greater than about ½ cm. This aperture facilitates equalization of air pressure between adjacent to front spreading surface 24 and adjacent to rear surface 26. Aperture 32 is preferably near the middle of the width of sheet 24 and near one end, preferably the end to be held uppermost during use. The provision of aperture 32 has been found to reduce the force which is required during spreading.

Sheet 22 may be made from a range of different materials including, but not limited to, various polymers and metals. One composition which has been found particularly advantageous is a polypropylene co-polymer with additives to reduce static electricity.

Figure 6A:
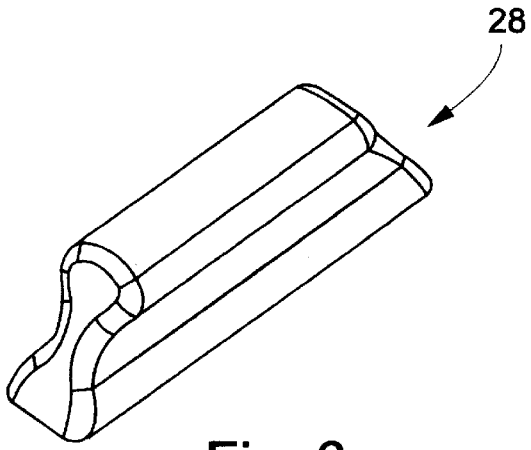
FIG. 6A is a perspective view of a preferred form of a handle for use in the plastering trowel of FIG. 2.
Figure 6B:
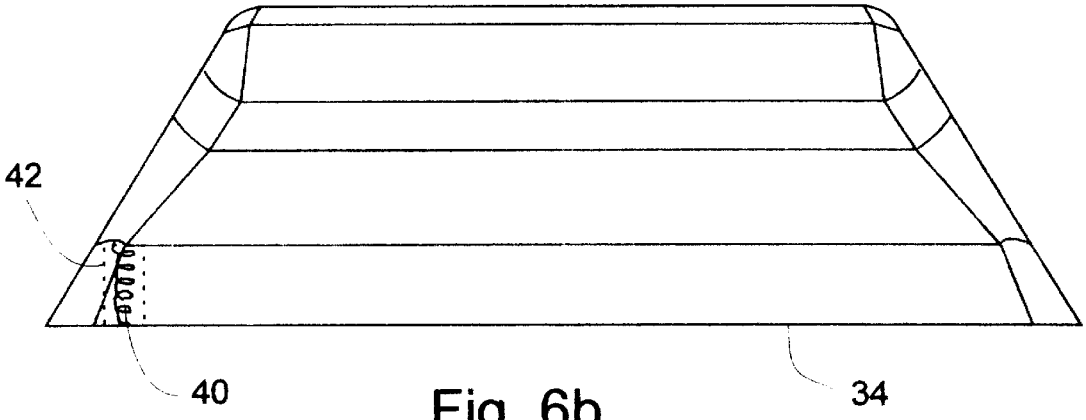
FIG. 6B is a side view of the handle of FIG. 6A.
Figure 6C:
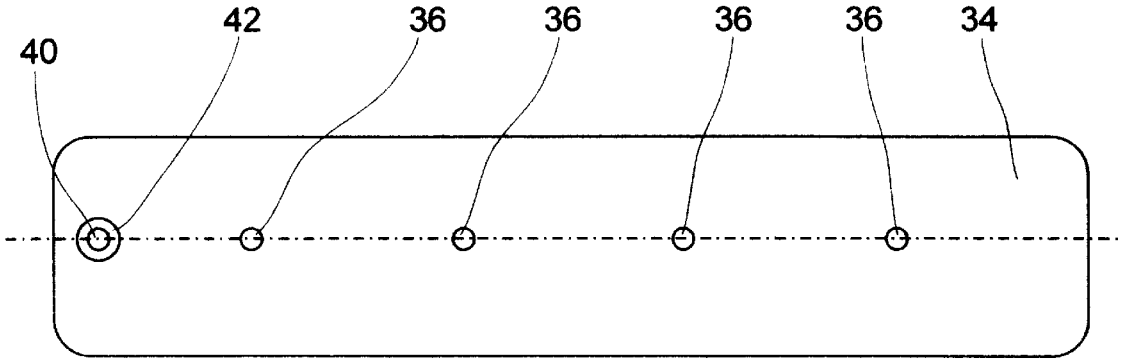
FIG. 6C is a bottom view of the handle of FIG. 6A.

Turning now to the features of handle 28, a first preferred implementation is shown in FIGS. 6A–6C. Handle 28 is preferably an ergonomic design which fits comfortably between the fingers and palm of one hand in a natural grasping position. In the implementation shown here, the sloped ends of handle 28 also provide a reference finger rest for the index finger to define the longitudinal position of the user's hand along the handle.

It is a particular feature of most preferred implementations of handle 28 that they are formed with a substantially planar lower face 34. This lower face is designed to extend along a major part of the length of the sheet such that it spreads applied pressure along the length of sheet 22 when the sheet is flexed to its flat state. Lower face 34 also typically features a number of screw holes 36 corresponding to the positions of holes 30 in sheet 22. It will be noted that attachment of sheet 22 to lower face 34 at four positions as shown will cause some local flattening of the curvature of sheet 22 in its intermediate portion. This localized flattening is not sufficient to interfere significantly with operation of trowel 20.

Additionally, handle 28 preferably features a spring element 40 mounted in a recess 42 near one end of lower face 34. Spring element 40 serves to apply a bending force on sheet 22 so as to maintain the required degree of curvature over a prolonged operational lifetime of trowel 20. If desired, a second spring element may be mounted at the opposite end of lower face 34. However, a single spring element has been found to maintain sufficient residual curvature to preserve the essential functional characteristics of trowel 20 even after the opposite end of sheet 22 has lost its intrinsic bend.

Handle 28 may be produced from a wide range of materials. It is a particular feature of certain preferred implementations of trowel 20 that the weight of handle 28, itself, and the relative weights of the handle and sheet 22 are chosen for comfort and ease of use. Specifically, the weight of handle 28 is preferably at least about twice the weight of the sheet. This ensures that the center of gravity of the trowel lies close to, or even within, handle 28 such that the trowel feels lightweight and maneuverable. The weight of the handle alone is preferably between about 150 and about 200 grams, and typically between about 160 and about 180 grams.

Figure 7A:
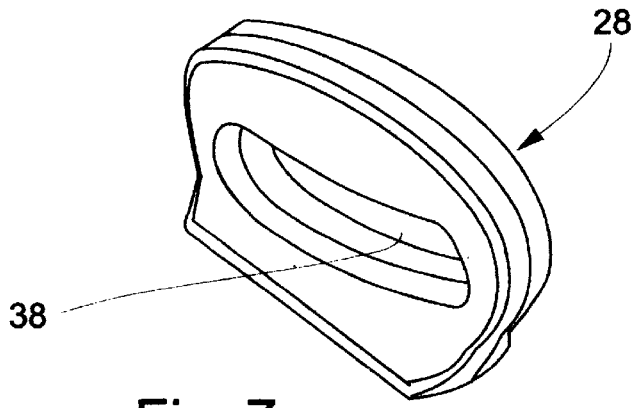
FIG. 7A is a perspective view of an alternative form of a handle for use in the plastering trowel of FIG. 2.
Figure 7A:
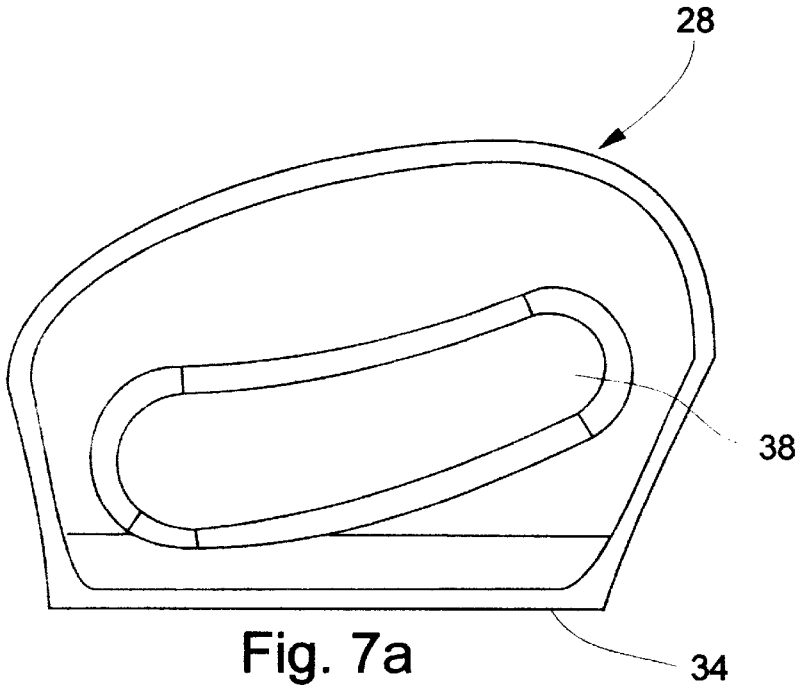
Figure 7C:
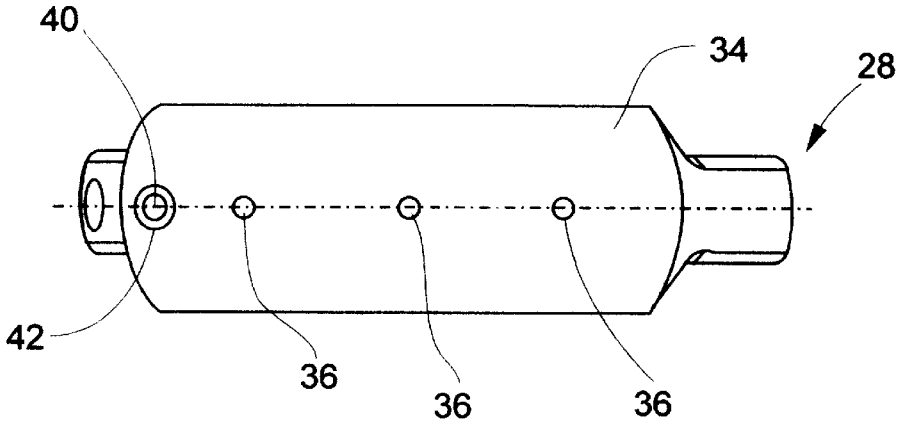
FIG. 7C is a bottom view of the handle of FIG. 7A.

Turning now to FIGS. 7A–7C, these show an alternative implementation of handle 28 formed with an open finger grip 38. This implementation also features flat lower surface 34, this time with only three screw holes 36. The number of holes 30 in sheet 22 and their positions would be varied accordingly.

It will be appreciated that the above descriptions are intended only to serve as examples, and that many other embodiments are possible within the spirit and the scope of the present invention.

What is claimed is:

1. A trowel for spreading material on a wall, the trowel comprising:

(a) a substantially rectangular sheet of material having a front spreading surface and a rear surface, said front spreading surface having a longer dimension termed "length" and a shorter dimension termed "width" and (b) a handle attached to said rear surface, wherein said sheet has an initial curvature such that said front spreading surface is concave along said length, said material being flexible such that, when the trowel is positioned with said front spreading surface adjacent to the wall and said handle is manually urged towards the wall said sheet flexes such that said front spreading surface becomes approximately planar.

2. The trowel of claim 1, wherein said sheet has two, parallel long edges separated by said width, said long edges being rounded away from said front spreading surface.

3. The trowel of claim 1, wherein said sheet has four corners, each of said corners being rounded with a minimum radius of curvature of about 1 cm.

4. The trowel of claim 1, wherein said sheet has two short edges separated by said length, said short edges being curved with a minimum radius of curvature of about 10 cm.

5. The Trowel of claim 1, wherein said sheet has at least one unobstructed aperture of diameter no greater than about ½ cm.

6. The trowel of claim 1, wherein said sheet is made from a polymer material.

7. The trowel of claim 1, wherein said handle is formed with a substantially planar face adjacent to said rear surface and extending along a major part of said length of said sheet such that said face spreads applied pressure along said length when said sheet is in said approximately planar flexed state.

8. The trowel of claim 1, wherein the weight of said handle is at least about twice the weight of said sheet.

9. The trowel of claim 1, wherein the weight of said handle alone is between about 150 and about 200 grams.

10. The trowel of claim 1, wherein the weight of said handle is between about 160 and about 180 grams.

11. A trowel for spreading material on a wall, the trowel comprising:

(a) a substantially rectangular sheet of material having a front spreading surface and a rear surface, said front spreading surface having a longer dimension termed "length" and a shorter dimension termed "width"; and (b) a handle attached to said rear surface, wherein said sheet has an initial curvature such that said front spreading surface is concave along said length, said material being flexible such that, when the trowel is positioned with said front spreading surface adjacent to the wall and said handle is manually urged towards the wall, said sheet flexes such that said front spreading surface becomes approximately planar, and wherein said handle is formed with a substantially planar face adjacent to said rear surface and extending along a major part of said length of said sheet such that said face spreads applied pressure along said length when said sheet is in said approximately planar flexed state.

* * * * *